US009359125B2

(12) United States Patent
Pavlu, Jr.

(10) Patent No.: US 9,359,125 B2
(45) Date of Patent: Jun. 7, 2016

(54) POP-UP BOUQUET BOX

(71) Applicant: HALLMARK CARDS, INCORPORATED, Kansas City, MO (US)

(72) Inventor: Robert R. Pavlu, Jr., Overland Park, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 360 days.

(21) Appl. No.: 13/900,278

(22) Filed: May 22, 2013

(65) Prior Publication Data

US 2014/0346069 A1 Nov. 27, 2014

(51) Int. Cl.

| | |
|---|---|
| ***B65D 5/50*** | (2006.01) |
| ***A63H 13/16*** | (2006.01) |
| ***B65D 85/50*** | (2006.01) |
| ***B65D 5/42*** | (2006.01) |

(52) U.S. Cl.

CPC ..... *B65D 85/505* (2013.01); *B65D 5/425* (2013.01)

(58) Field of Classification Search

CPC ..... A63H 13/16; B65D 21/086

USPC ..... 206/768, 774, 761; 446/310, 147, 148, 446/149, 150, 151, 152, 78, 486, 487, 488; 220/8, 720, 721, 722; 229/116.1; 40/124.08, 539

See application file for complete search history.

(56) References Cited

U.S. PATENT DOCUMENTS

| | | | |
|---|---|---|---|
| 4,185,767 | A | 1/1980 | Pollack et al. |
| 4,337,589 | A | 7/1982 | Volkert et al. |
| 6,306,485 | B1 | 10/2001 | Keller |
| 2012/0285861 | A1 | 11/2012 | Glass et al. |

*Primary Examiner* — J. Gregory Pickett
*Assistant Examiner* — Allan Stevens
(74) *Attorney, Agent, or Firm* — Shook, Hardy & Bacon L.L.P.

(57) ABSTRACT

A gift box is described for housing a plurality of pop-up elements that are automatically presented to a user when a lid of the box is removed. The box includes an interior portion enclosed by a base and sidewalls around its outer periphery. The interior portion of the gift box contains a central tower coupled to four levers that each pivot on a respective sidewall. The central tower and/or the four levers additionally have one or more paper pop-up elements attached thereto that are presented to a user when the box is opened. A band passing through the interior portion of the box stores the mechanical energy necessary to cause the four levers to pivot on the sidewalls, thereby generating the force to move the central tower out of the box when the lid is removed.

20 Claims, 10 Drawing Sheets

POP-UP BOUQUET BOX

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

Embodiments of the invention are defined by the claims below, not this summary. A high-level overview of various aspects of the invention are provided here for that reason, to provide an overview of the disclosure, and to introduce a selection of concepts that are further described in the detailed description section below. This summary is not intended to identify key features or essential features of the claimed subject matter, nor is it intended to be used as an aid in isolation to determine the scope of the claimed subject matter. In brief and at a high level, this disclosure describes, among other things, a gift box with a lid, sidewalls, a base, levers, elastic bands that pull the levers, and a central tower disposed therein. When the lid is removed, tension in the elastic band is released, and the band shortens. The shortening of the band causes each of the four levers to pivot on four corresponding sidewalls of the container. The central tower, which is connected to a lower end of each lever, rises out of the interior portion of the container as the levers pivot out from the interior of the box. As the central tower rises, one or more "pop-up" elements affixed thereto partially unfold along a series of fold lines. In one embodiment, the pop-up elements are paper flowers that unfold to create a paper flower bouquet. In another embodiment, the central tower is configured to receive a gift, such as a gift card, that is automatically presented to a user when the lid is removed.

BRIEF DESCRIPTION OF THE SEVERAL VIEWS OF THE DRAWINGS

The present invention is described in detail below with reference to the attached drawing figures, in which like reference numerals denote like elements, wherein.

DETAILED DESCRIPTION OF THE INVENTION

Figure 1:
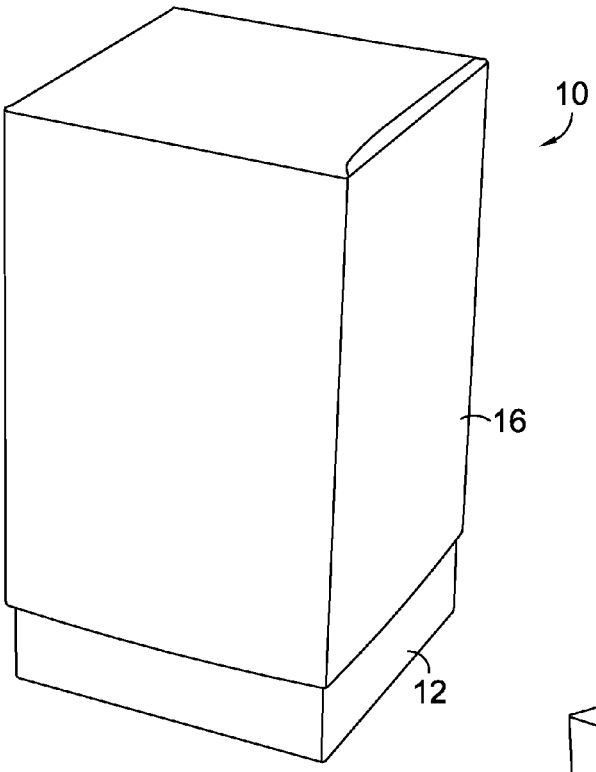
FIG. 1 is a perspective view of a first embodiment of a gift box in accordance with the present invention in a closed condition.

The subject matter of select embodiments of the invention is described with specificity herein to meet statutory requirements. But the description itself is not intended to necessarily limit the scope of claims. Rather, the claimed subject matter might be embodied in other ways to include different steps, components, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to a gift box. However, such is not intended to limit embodiments to any particular configuration of an input device as described herein. Further, exemplary materials, components, and methods of manufacture described herein are intended to aid in providing an understanding of embodiments of the invention. They are not intended to limit embodiments of the invention to any particular materials, components, or methods of manufacture unless explicitly stated otherwise.

At a high level, embodiments of this invention relate to a pop-up gift box designed to automatically present at least one pop-up element when its lid is removed. The pop-up gift box has an interior portion formed by four sidewalls and a base. Connected to each of the four sidewalls are four flaps. Each flap is moveable and, in some embodiments, may have a shorter width and height than each of the four sidewalls. Affixed to each flap is a lever. The flap secures the lever so that it may pivot over a corresponding sidewall, which serves as a fulcrum for the lever. Each lever is connected to a lower end of a central tower that is movable in a vertical direction in and out of the box.

In one embodiment, a band runs through a substantially central portion of the box. Each end of the band passes through a hole in one of two opposite sidewalls and is fastened to an upper portion of one of the two levers that pivot about the two opposite sidewalls. The band provides the necessary tension to pull the levers to a generally perpendicular orientation with respect to the corresponding sidewalls, thereby causing the levers to push the central tower out of a top opening of the box. As the central tower rises out of the box, various pop-up elements affixed to the central tower may partially or wholly unfold along a series of fold lines, creating a three-dimensional paper gift (e.g., a bouquet of paper flowers).

Referring now to the drawings in more detail and initially to FIGS. 1-9 and 14, numeral 10 generally designates a gift box constructed in accordance with a first embodiment of the present invention. The box 10 includes a body portion having a sidewall 12 and a base 14. The box also includes a lid 16. The lid 16 has four sides, a top portion, and an interior hollow space. The lid's interior space is large enough to fit around the sidewall 12, and it may cover all or just a portion of the body portion of the box 10. When the lid 16 covers a top portion of the box 10, the sidewall 12 remains in a vertical orientation, with an exterior portion of the sidewall 12 abutting an interior surface of the lid 16. In embodiments, the lid 16 and the body portion of the box 10 are made of card stock or another semi-rigid paper material.

Figure 2:
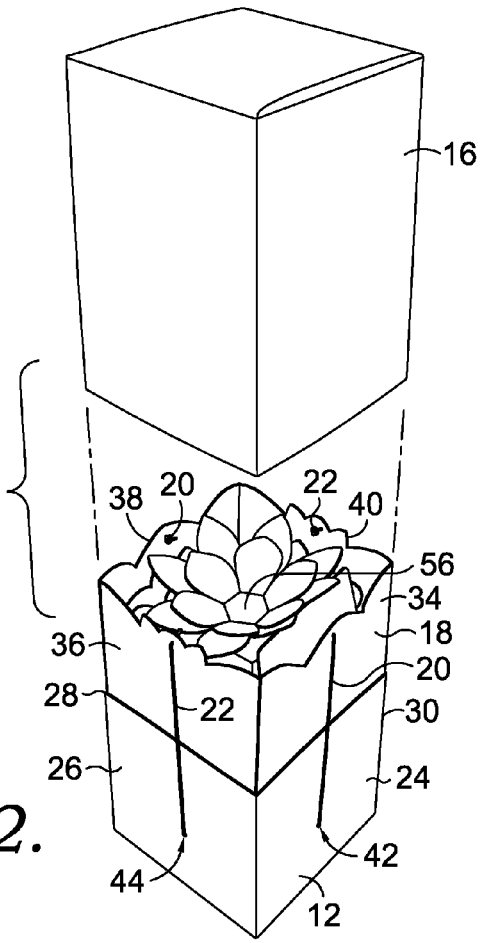
FIG. 2 is an exploded perspective view of the gift box of FIG. 1.
Figure 5:
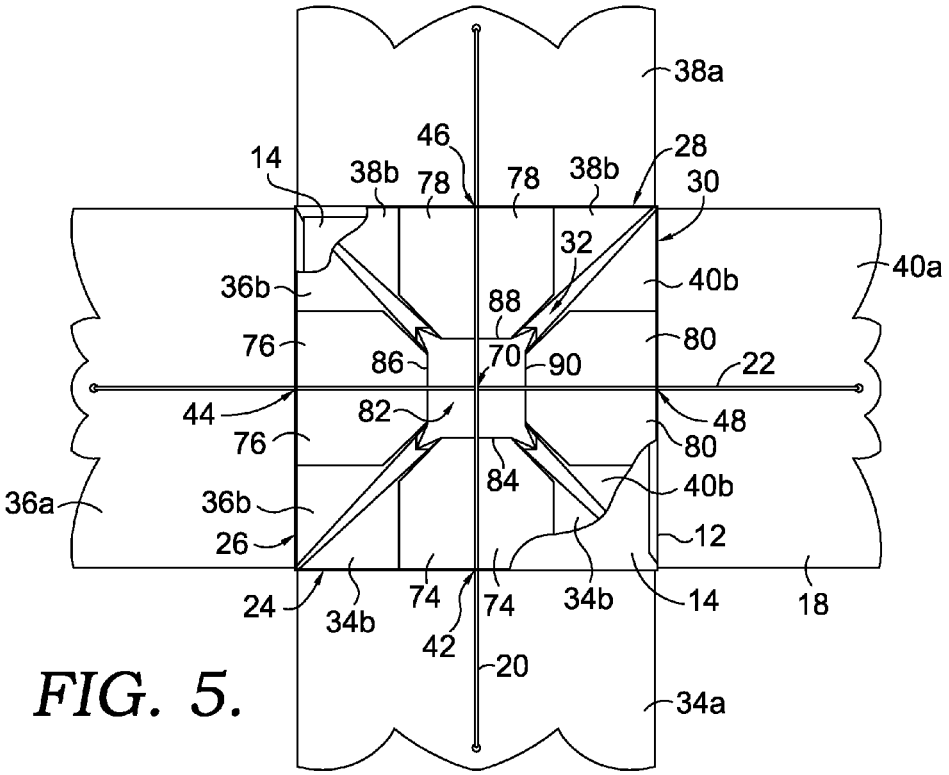
FIG. 5 is a bottom plan view of the gift box of FIG. 4 with a portion of a base wall cutaway to reveal an interior portion.

As shown in FIGS. 2 and 5, the sidewall 12 includes a front sidewall 24, a right sidewall 26, a rear sidewall 28, and a left sidewall 30. The sidewalls 24 and 26 are connected to the sidewalls 28 and 30 and cooperate with the base 14 to define an interior portion 32 of the body portion of the box 10. Each sidewall 12 contains a hole that is positioned in a generally central location on the sidewall 12. For example, holes 42 and 44 are positioned in a location that is generally equidistant from vertical edges or corners of each of sidewalls 24 and 26, respectively. Each hole is designed so that a band, such as band 20 or band 22, can pass through the hole. The bands 20, 22 may be made of elastic or another stretchable material configured to store and release mechanical energy.

The box 10 has four levers 18, namely, a front lever 34, a right lever 36, a rear lever 38, and a left lever 40. Each lever 18 pivots on each respective sidewall 12 via a flap, such as flaps 74, 76, 78, and 80 of FIG. 5. An exterior surface of the flaps 74, 76, 78, and 80 may be glued or otherwise adhered to an interior surface of the lever 18. The flaps 74, 76, 78, and 80 and the levers 34, 36, 38, and 40 move in a same direction when they are connected. The lever 18 is movable by a user that pushes or pulls the lever 18. Each lever 18 is also movable by the bands 20, 22, as described in greater detail below. Each lever 18 is cut from a piece of material, such as a card stock or cardboard.

The sidewall 12 touches the lever 18 at a pivot point that divides the lever 18 between an upper end and a lower end. In this way, the upper ends 34*a*, 36*a*, 38*a*, and 40*a* of the lever 18 and the lower ends 34*b*, 36*b*, 38*b*, and 40*b* of the lever 18 are distinguishable based on the location of the sidewall 12 beneath the lever 18. For example, lever 34 is divided between an upper end 34*a* and a lower end 34*b* at the point where the sidewall 24 touches the lever 34.

The lower ends 34*b*, 36*b*, 38*b*, and 40*b* of the lever 18 are disposed within the interior portion 32 of the box 10 when the lid 16 is covering the top opening of the body portion of the box 10. Thus, the interior surface of the lower ends 34*b*, 36*b*, 38*b*, and 40*b* of each lever 18 may abut or nearly abut the interior surface of the sidewall 12 when the lever 18 is generally in a vertical orientation, as shown in FIG. 2. Each of the lower ends 34*b*, 36*b*, 38*b*, and 40*b* of lever 18 are configured to be disposed in the interior portion 32 of the box 10 at the same time. The lever 18 may, in some embodiments, have upper ends 34*a*, 36*a*, 38*a*, and 40*a* that are shaped differently than the lower ends 34*b*, 36*b*, 38*b*, and 40*b*. For example, in the illustrated embodiment, the lower end 36*b* of lever 36 is trapezoidal-shaped while the upper end 36*a* of lever 36 is rectangular-shaped. In some embodiments, a distal portion of the upper ends 34*a*, 36*a*, 38*a*, and 40*a* of the lever 18 may be decorative. For example, in the illustrated embodiment, the upper end 36*a* of lever 36 is cut to depict a leaf or a flower.

Figure 3:
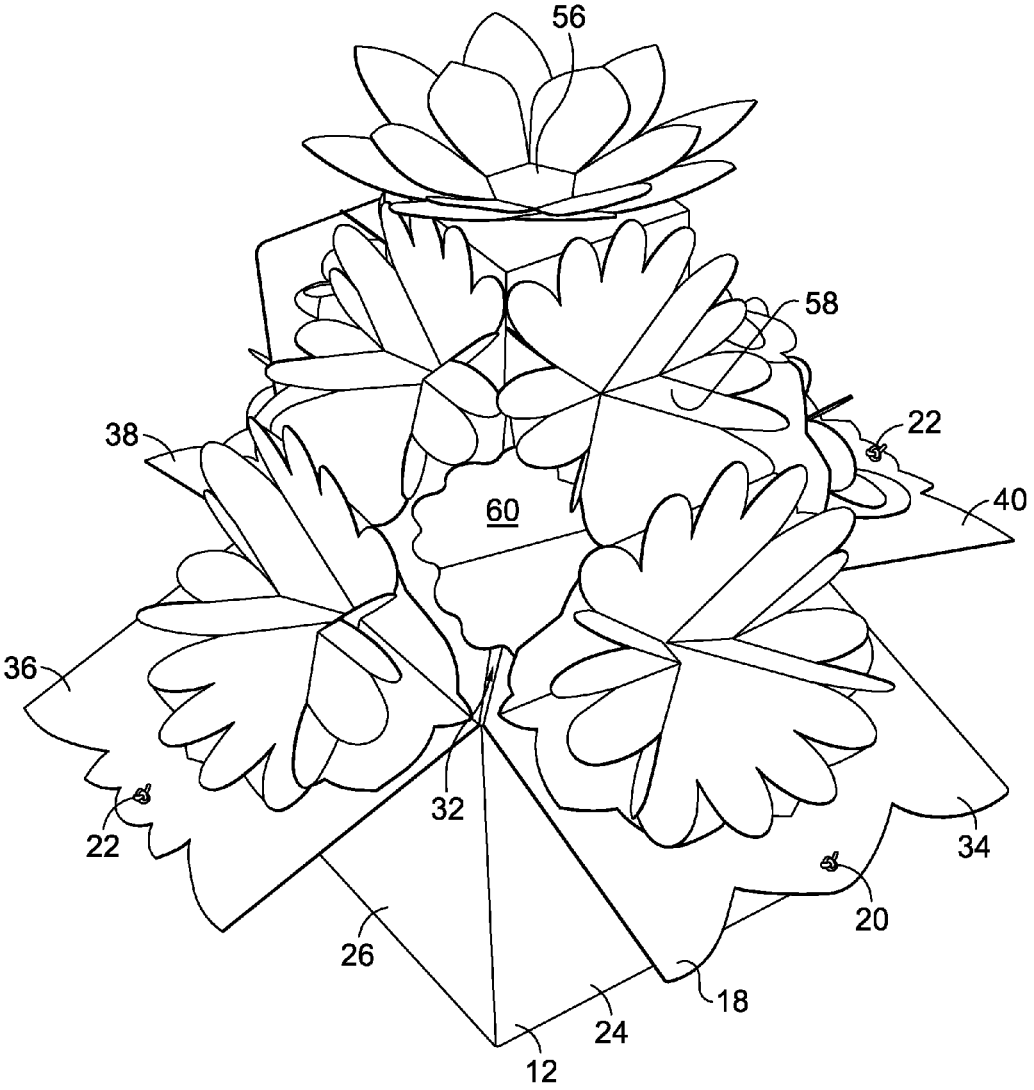
FIG. 3 is a top perspective view of the gift box of FIG. 1 in a fully opened condition after removal of a lid.
Figure 4:
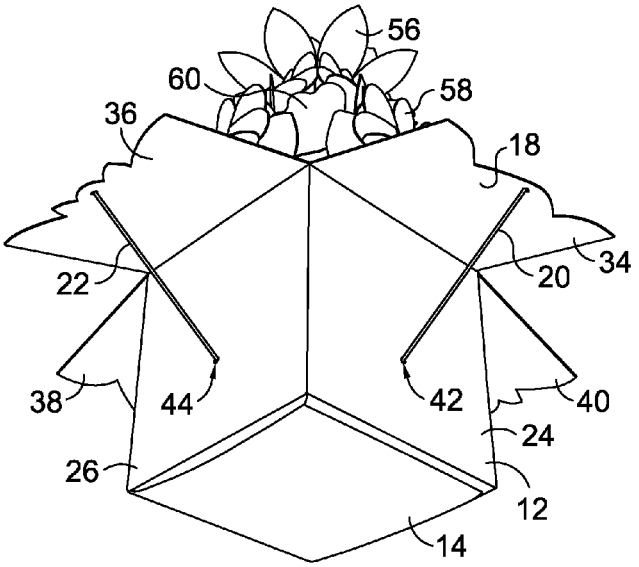
FIG. 4 is a bottom perspective view of the gift box of FIG. 3.

Turning to FIG. 3, the bands 20, 22 may, after passing through the interior portion 32 of the base portion of the box 10 through the holes in opposite sidewalls (e.g., 26 and 30), attach to two levers connected to the corresponding opposite sidewalls (e.g., levers 36 and 40). For example, band 22 is fastened to lever 36 by passing therethrough, enters the hole 44 in sidewall 26, passes through a substantially center portion of the interior space 32, exits the hole 48 of sidewall 30, passes through the hole in lever 40, and is fastened to lever 40, as shown in FIGS. 3-5. A similar arrangement is envisioned for the band 20 as it attaches to levers 34 and 38 and passes through sidewalls 24 and 28. Band 20 and band 22 may cross in the interior portion 32 at a substantially right angle 70. In some embodiments, only a single band passes through the interior portion of the box 10.

The bands 20, 22 may be fastened or affixed to opposite levers (e.g., levers 36 and 40) via an adhesive, a slit, a brad, a knot, or the like. In one embodiment, bands 20, 22 are fastened with a knot at each end after passing through holes in opposite levers 34 and 38 or 36 and 40. The holes may generally be located in the center (i.e., generally equidistant laterally or side to side) of a distal portion of the upper ends 34*a*, 36*a*, 38*a*, and 40*a* of each lever 18. It will be understood, however, that the location of the holes in the lever 18 may vary while still achieving the object of the present invention.

When the lid 16 covers the top opening of the body portion of the box 10, and when the levers 34, 36, 38, and 40 are positioned in an upright vertical orientation, as shown in FIG. 2, a tension exists in the bands 20, 22. It is this tension that causes the bands 20 and/or 22 to automatically pull each lever 18 (e.g., lever 26) outwardly and downwardly toward its corresponding sidewall 12 (e.g., sidewall 26). For example, when the lid 16 is removed from the box 10, each of the levers 34, 36, 38 and 40 automatically move from the substantially vertical orientation shown in FIG. 2 to the substantially horizontal orientation shown in FIGS. 3 and 4.

Figure 6:
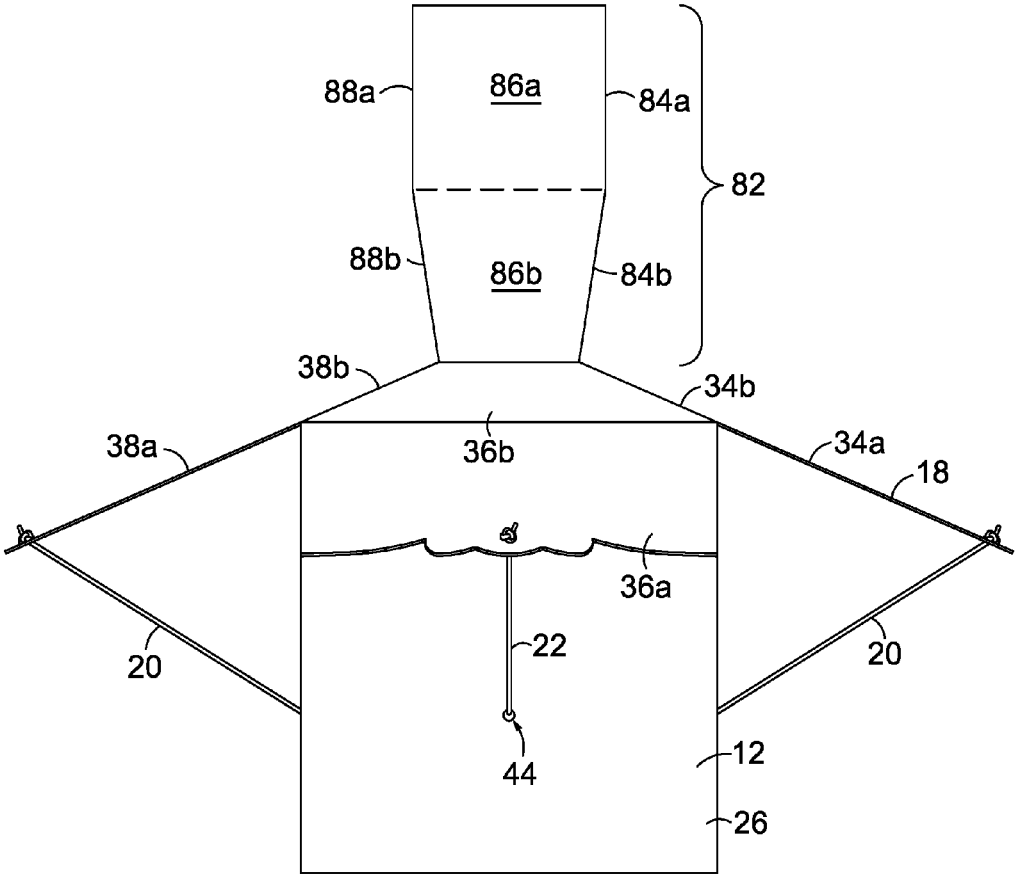
FIG. 6 a right side elevation view of the gift box of FIG. 3 with pop-up elements removed for clarity.
Figure 8:
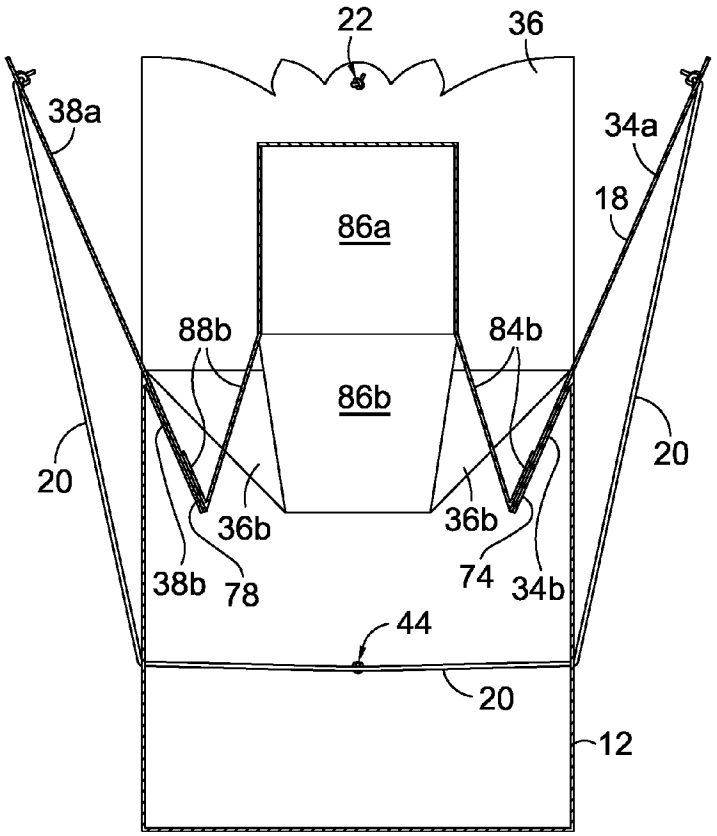
FIG. 8 is a cross-sectional view of the gift box of FIG. 7.
Figure 7:
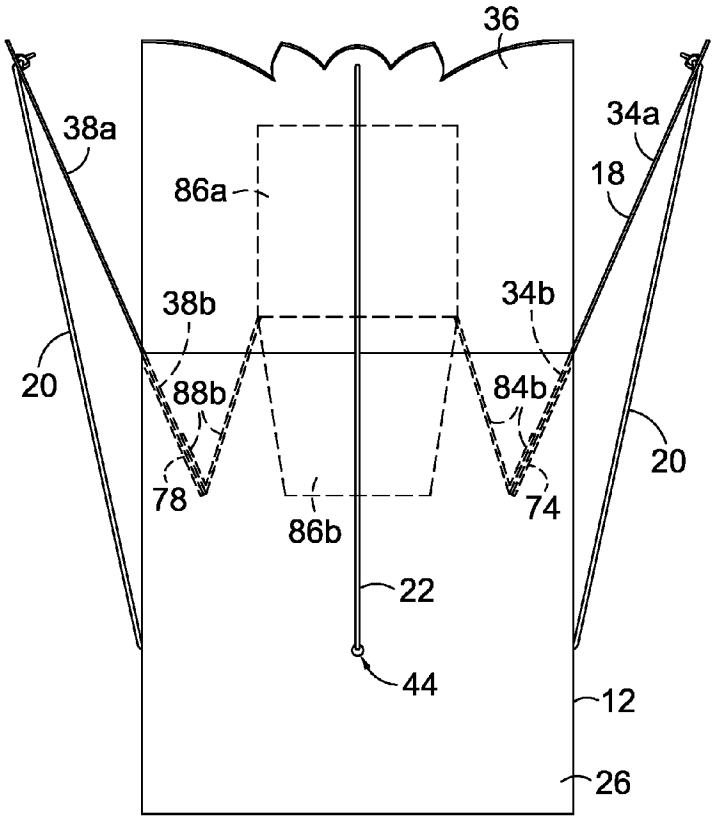
FIG. 7 is a right side elevation view of the gift box of FIG. 6 with levers or side panels being folded up and dashed lines illustrating the structures contained therein.
Figure 9:
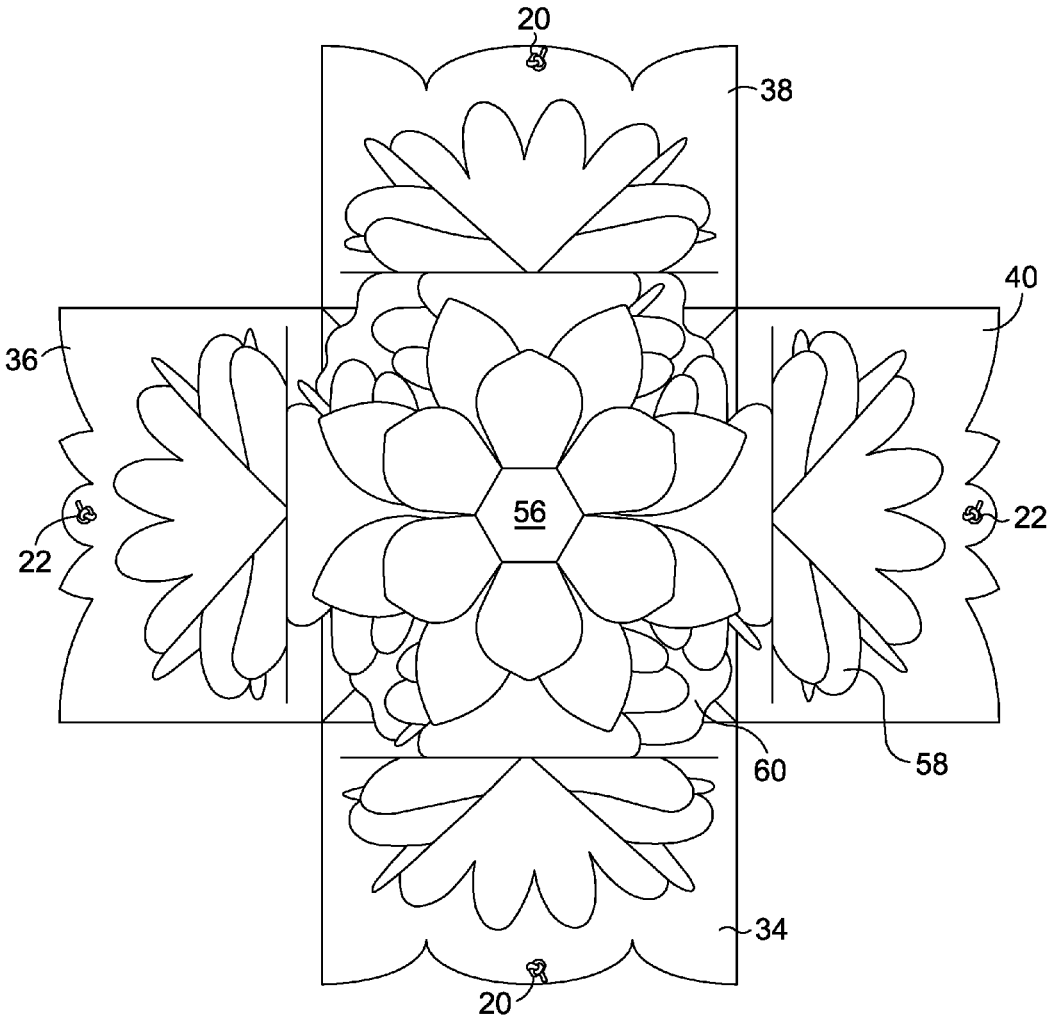
FIG. 9 is a top plan view of the gift box of FIG. 3.

With reference to FIGS. 6-8, each lever 18 is directly or indirectly connected to a central tower 82 that is configured to move in and out of the body portion of the box 10 in a vertical direction from a first position (e.g., disposed within the box) to at least a second position (e.g., out of the top opening of the box). The central tower 82 moves when the levers 18 pivot on the sidewall 12. In particular, when the upper end of each lever 18 moves outwardly and the lower ends pivot upwardly, the central tower 82 rises in an upward vertical direction. Conversely, when the lower ends 34*b*, 36*b*, 38*b*, and 40*b* of the levers 18 move downward and toward the interior surface of sidewalls 24, 26, 28, and 30, the central tower 82 lowers in a vertical direction. In embodiments, lower ends 84*b*, 86*b*, 88*b*, and 90*b* (not visible in the views depicted in FIGS. 6-8 but shown in FIG. 14) of the central tower 82 are unconnected to each adjacent lower end so they can move toward and away from each other as the central tower 82 is raised and lowered. Thus, when partially disposed within the interior portion of the box, the lower ends 84*b*, 86*b*, 88*b*, and 90*b* of the central tower 82 may be spaced apart from one another. As the central tower 82 rises upward, however, each lower end 84b and 88b may move toward its two adjacent lower ends 86*b* and 90*b* and eventually abut at generally perpendicular angles, forming a rectangular structure. At the point the lower ends 84*b*, 86*b*, 88*b*, and 90*b* of the tower abut and the central tower 82 stops moving.

The central tower may be made of card stock, paperboard or another semi-resilient material (e.g., plastic). In one embodiment, the central tower 82 has four sides. The four sides include a front side 84, a right side 86, a rear side 88, and a left side 90. The upper ends 84a, 86a, 88a, and 90a (not visible in the views depicted in FIGS. 6-8 but shown in FIG. 14) of the central tower 82 are all connected to one another. The lower ends 84*b*, 86*b*, 88*b*, and 90*b*of the central tower 82 are separate from one another. The lower ends 84*b*, 86*b*, 88*b*, and 90*b* of the central tower 82 are connected to the respective lower ends 34*b*, 36*b*, 38*b*, and 40*b* of the levers 18. When the central tower 82 is partially or wholly disposed in the interior portion 32 of the box 10, the lower ends 84*b*, 86*b*, 88*b*, and 90*b* of the central tower 82 fold inwardly toward the respective lower ends 34*b*, 36*b*, 38*b*, and 40*b* of the levers 18 and inwardly toward the upper ends 84a, 86a, 88a, and 90a of the central tower 82. As the central tower 82 moves vertically upward out of the top portion of the box 10, the lower ends 84*b*, 86*b*, 88*b*, and 90*b* of the central tower 82 fold outwardly away from the respective lower ends 34*b*, 36*b*, 38*b*, and 40*b* of the levers 18 and also outwardly from the upper ends 84*a*, 86*a*, 88*a*, and 90*a* of the central tower 82. Each side 84, 86, 88, and 90 of the central tower 82 is spaced apart and is positioned at a generally at a parallel orientation to each corresponding sidewall 24, 26, 28, and 30, respectively.

Figure 10:
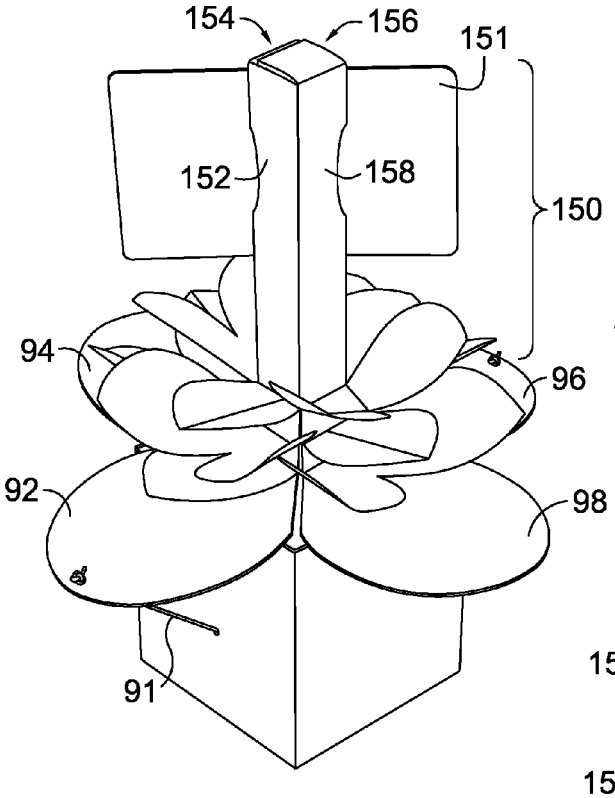
FIG. 10 is a perspective view of a gift box in accordance with a second embodiment of the present invention in a fully opened condition and includes a second central tower holding a gift card.
Figure 11:
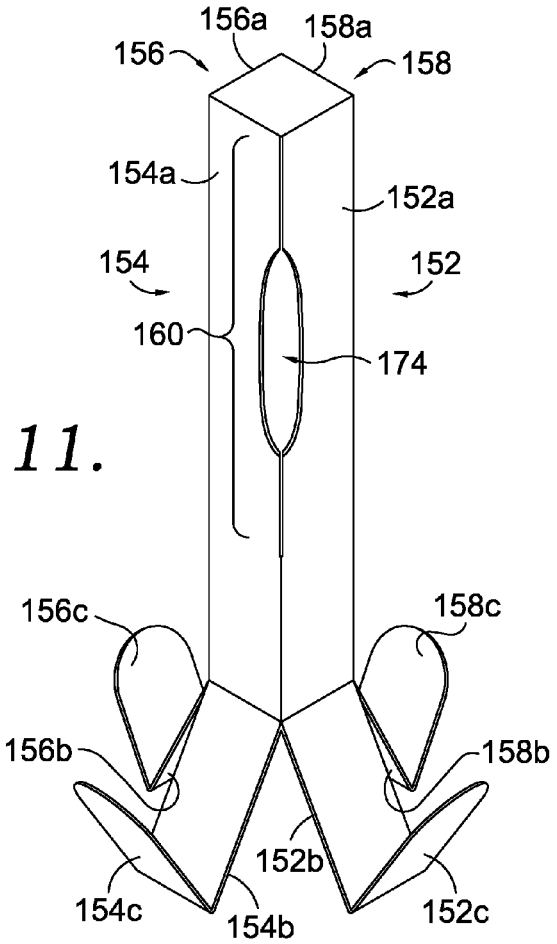
FIG. 11 is a perspective view of the central tower of the gift box of FIG. 10.

Multiple configurations of the central tower 82 are possible. For example, FIGS. 10 and 11 illustrate a central tower 150 of a second embodiment that is configured to receive a gift, namely a gift card 151. In this way, the central tower 150 contains slits 160, located at the confluence of sides 152 and 158 and the confluence of sides 154 and 156. The slits 160 lead to an interior portion 174 where a gift card 151 may be placed by a user. The central tower 150 has sides 152, 154, 156, and 158 that have a greater height than the sides 84, 86, 88, and 90 of first embodiment of the central tower 82. In embodiments, the central tower may be comparatively smaller than the central towers 82 and 150. For example, in a third embodiment, a tower 110 of FIG. 12, has a shorter height, width, and length than central towers 82 and 150. Thus, different heights, widths and lengths of the central towers 82, 110 and 150 are contemplated as being within the scope of the embodiments.

Adhered to the central tower 82 and/or the levers 18 may be a series of pop-up elements. Exemplary pop-up elements include pop-up elements 56, 58, and 60, as shown in FIGS. 2-4 and FIG. 9. Other less elaborate pop-up elements are within the scope of the embodiments described herein, including the exemplary pop-up elements shown in FIGS. 10 and 12. The pop-up elements may be made of the same material as the levers 18, the sidewall 12 and/or the central tower 82. Some of the pop-up elements may be made of a different material such as paper, a fabric, a plastic, or any other foldable material. The material used may depend on the size of the box 10, the number of bands 20 or 22, and the like.

The pop-up elements are folded in a variety of configurations along a plurality of lines. Exemplary pop-up elements include paper flowers, paper petals, cartoons, sentiments, paper animals, and the like. When disposed in the interior portion 32 of the box 10, the pop-up elements may be in a folded or substantially flat orientation. When the central tower 82 rises upward and the levers 18 pivot outwardly from the interior portion 32 of the box 10, the pop-up elements unfold along each of their lines. For example, FIGS. 3, 9, 10 and 12 illustrate a variety of pop-up elements that have partially unfolded along a series of fold lines to create a paper bouquet of flowers.

Figure 12:
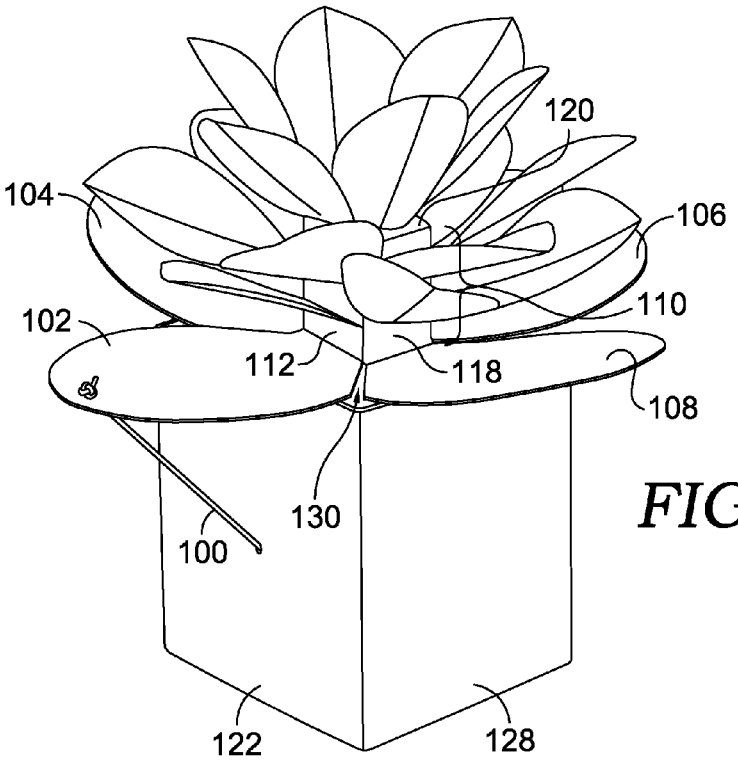
FIG. 12 is a perspective view of a gift box in accordance with a third embodiment of the present invention in a fully opened condition.

In embodiments, the box 10 may come in any number of sizes, such as the different sizes of boxes shown in FIGS. 3, 10, and 12. As well, each of the levers and central towers may be cut and folded in different manners, as described below. The box 10 in these figures may have similar components to those shown in other embodiments. For example, in FIG. 12, the box 12 may have a four sidewalls, including the front sidewall 122 and the left sidewall 128 shown in FIG. 12. The box 10 may also have four levers 102, 104, 106, and 108 that each pivot on a sidewall. There may be at least one band attached to two opposing sidewalls such as band 91 in FIG. 10 or band 100 in FIG. 12.

While the central towers 82, 110 and 150 were discussed above in relation to their multiple sides and generally rectangular shape, it should be noted the central towers 82, 110 and 150 could each be manufactured from a single piece of paper or cardstock. In that regard, FIGS. 14-16 illustrate die cut blanks of cardstock or paperboard material which can be folded along the illustrated fold lines to make the central towers 82, 110, and 150 of the present invention.

Figure 14:
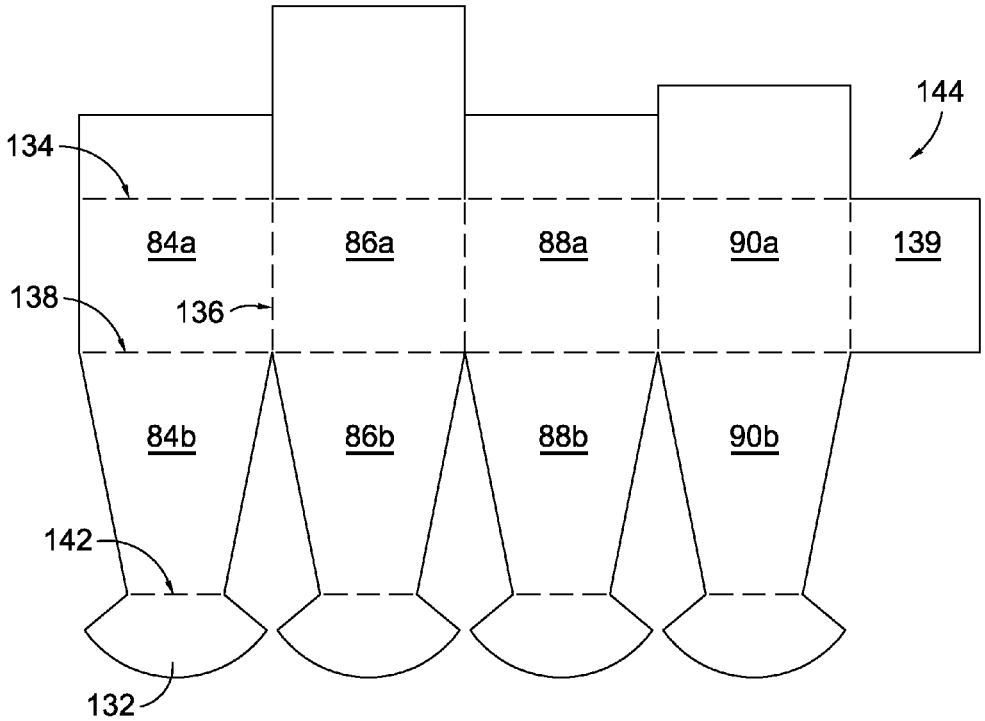
FIG. 14 illustrates a plan view of a blank of material that can be folded along the illustrated fold lines to make a first central tower of the first embodiment of the gift box illustrated in FIGS. 1-9.

With reference to FIG. 14, the majority of the portions of the blank 144 are readily identifiable by their numerals as discussed above with reference to FIGS. 2-9. However, the blank 144 also includes tabs 132 which connect at their interior surface to the levers 18 at their exterior surface. Each tab 132 is folded inwardly along fold line 142. At the fold 142, the angle between the exterior surface of lower end 84*b* and the exterior surface of the tab 132 may grow or shrink, respectively, as the central tower 82 moves up and down. At the fold 138, the angle between the exterior surface of the lower end 84*b* and the exterior surface of the upper end 82*a* may grow or shrink, respectively, as the central tower 82 moves up and down. At the fold 134, a top portion of the central tower 82 may be folded at a generally perpendicular orientation to the upper end 84*a*.

The blank 144 also includes a right wing section 139. The upper ends 84*a* and 88*a* may be folded inwardly along folds 136 to abut at generally perpendicular angles to the upper ends 86*a* and 90*a*. At this point, the right wing 139 may be folded along fold 136 to arrive at the orientation illustrated in FIG. 5. The right wing 139 can be glued to an interior surface of the upper end 84*a* of the central tower 82.

Figure 15:
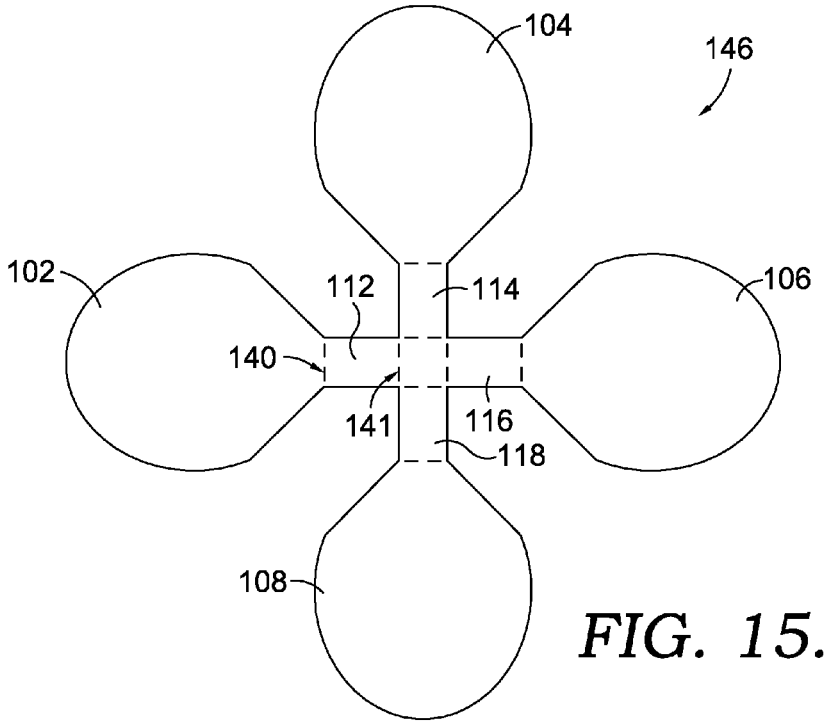
FIG. 15 illustrates a plan view of a blank of material that can be folded along the illustrated fold lines to make a third central tower of the third embodiment of the gift box illustrated in FIGS. 12-13.
Figure 16:
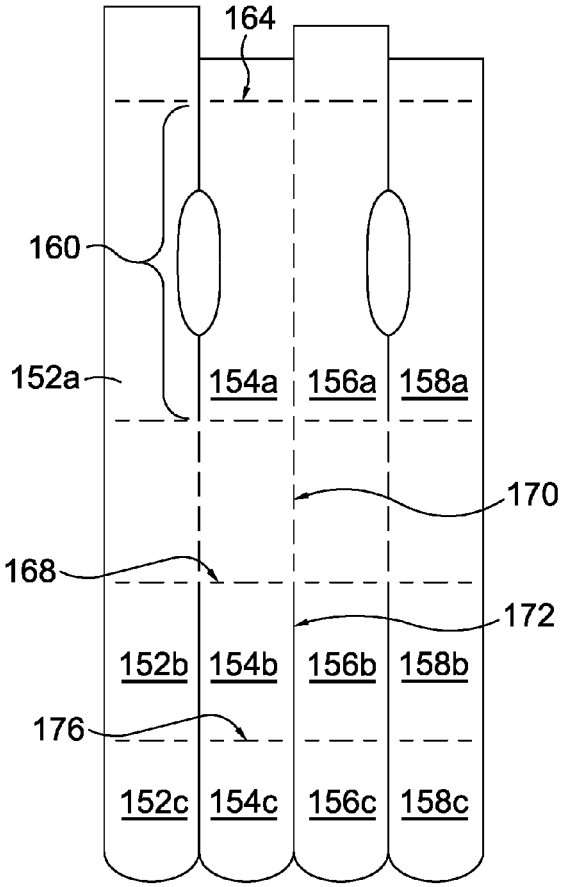
FIG. 16 illustrates a plan view of a blank of material that can be folded along the illustrated fold lines to make the second central tower of the second embodiment of the gift box illustrated in FIGS. 10, 11, and 17.

Similarly, turning to FIG. 15, the majority of the portions of the blank 146 are readily identifiable by their numerals as discussed above with reference to FIGS. 12-13. As with blanks 144 and 148, the blank 146 may be made from cardstock or paperboard material which can be folded along the illustrated fold lines to make the central tower 110 of FIGS. 12-13. The blank 146 can be stamped or die cut from a single sheet of material.

Figure 13:
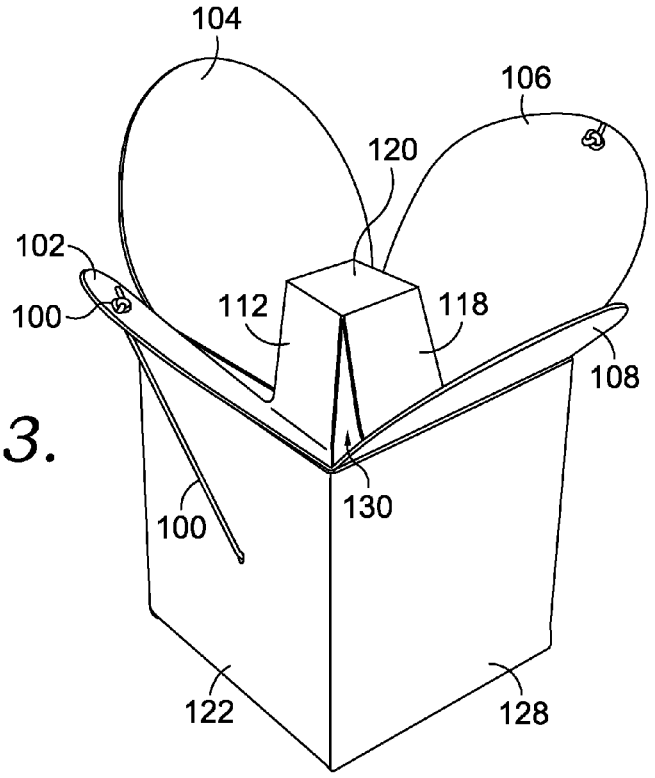
FIG. 13 is a perspective view of the gift box of FIG. 12 in a partially opened condition and with pop-up elements removed for clarity.

For simplicity sake, the discussion provided herein for FIG. 15 will be limited to side 112, but it applies equally to the other three sides, sides 114, 116, and 118, of the central tower 110. The blank 146 includes a fold 140 that causes the exterior surface of the side 112 to fold inwardly toward the exterior surface of the lever 102 when the central tower 110 is partially disposed within the box. The fold 140 also allows the exterior surface of side 112 to move outwardly from the exterior surface lever 102 when the central tower 110 moves in a vertical direction out of the interior portion 130 of the box, as shown in FIGS. 12-13. The blank 146 also includes a fold 141 that causes an interior surface of the side 112 to fold inwardly toward an interior surface of the top portion 120 of the central tower 110 when the central tower 110 moves in an upward direction, as shown in FIGS. 12-13. Conversely, the interior surface of the side 112 folds outwardly from the interior surface of top portion 120 along fold 141 when the central tower 110 moves into the interior portion 130 of the box, as shown in FIG. 13. Accordingly, the levers may be formed as part of the central tower, as illustrated in the third embodiment, or as part of the body portion, as illustrated in the first and second embodiments, or as individual pieces.

In the same regard, FIG. 16 illustrates a blank of cardstock or paperboard material which can be folded along the illustrated fold lines to make the central tower 150 of the present invention. The blank 148 can be stamped or die cut from a sheet of material.

The majority of the portions of the blank 148 are readily identifiable by their numerals as discussed above. However, the blank 148 also includes tabs 152*c*, 154*c*, 156*c*, and 158*c*, which are connected, via an adhesive, to levers 92, 94, 96, and 98, respectively. For simplicity sake, the discussion provided herein for FIG. 16 will be limited to side 154, but it applies equally to the other four sides of the central tower 150. The tab 154*c* may move inwardly and outwardly at fold 176 with respect to the lower end 154*b*. The lower end 154b may additionally move inwardly and outwardly at fold 168 with respect to the upper end 154*a*. The lower end 154*b* is cut along fold 172. And upper end 154*a* is separated from the adjacent upper end 152*a* along slit 160 so that a user may insert a gift card 151 into the central tower 150, as shown in FIG. 10. At fold 164, the upper end 154*a* of the side 154 folds at a generally perpendicular angle to form a top portion of the central tower 150. Upper ends 154*a* and 156*a* fold at fold 170 a generally perpendicular angle to each of upper ends 152*a*and 158*a* to form a rectangular structure.

Figure 17:
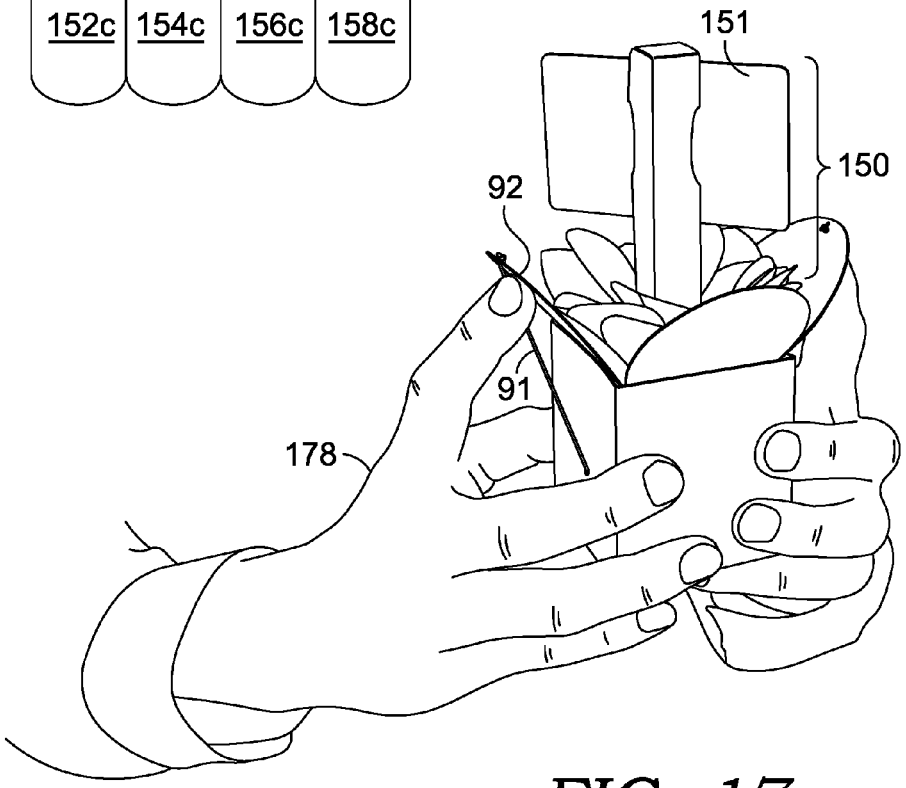
FIG. 17 illustrates a perspective view of the gift box of FIG. 11 being returned to a closed position.

After the box is opened, it may be returned to its closed position for reuse when a user 178 pushes the levers upward (or the central tower 150 downward), as shown in FIG. 17, and places the lid back on. Accordingly, the present invention discloses a gift box that quickly and unexpectedly pops open upon removal of the lid to present a display substantially larger in volume than the space it occupied when closed, much to the delight of the recipient.

Many variations can be made to the illustrated embodiment of the present invention without departing from the scope of the present invention. Such modifications are within the scope of the present invention. For example, instead of using bands 20, 22 in combination, a single band 20 or band 22 could be used and accomplish generally the same objects. Such modification would be within the scope of the present invention. As well, blanks 144 and 148 may have tabs that form the top portion of the central towers 82 and 150 that are of many different sizes. Additionally, the box 10 could be configured to be various different sizes to hold multiple combinations and sizes of pop-up elements.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A box that presents a pop-up display, the box comprising:

four sidewalls, wherein a first and a second of the four sidewalls are positioned opposite one another, and wherein a third and a fourth of the four sidewalls are positioned opposite one another;

a base coupling the four sidewalls;

an interior portion formed by the four sidewalls and the base;

a first band that passes through the interior portion via a first hole located in the first sidewall and a second hole located in the second sidewall, wherein the first band is fastened to a first lever and a second lever that pivot on the first sidewall and the second sidewall, respectively; and a central tower that is connected to the first lever and the second lever, wherein the central tower moves in a vertical direction out of a top opening of the box when a release of tension in the first band causes portions of the first and second levers to pivot outwardly from the box.

2. The box of claim 1, further comprising a lid which removably receives portions of the first and second levers and covers the top opening of the box, and wherein the release of tension in the first band occurs when the lid is removed.

3. The box of claim 1, further comprising a second band that passes through the interior portion via a third hole located in the third sidewall and a fourth hole located in the fourth sidewall, wherein the second band is fastened to a third lever and a fourth lever that pivot on the third sidewall and the fourth sidewall, respectively.

4. The box of claim 3, wherein the first band and the second band pass through the interior portion at a substantially right angle to one another.

5. The box of claim 3, wherein the first band and the second band are made of an elastic material.

6. The box of claim 3, wherein the central tower is connected to the third lever and the fourth lever.

7. The box of claim 1, wherein pop-up elements are adhered to the central tower, wherein movement of the central tower down in to the top opening of the box increases tension in the first band and folds the pop-up elements up, and wherein movement of the central tower up out of the top opening of the box decreases tension in the first band and unfolds the pop-up elements.

8. The box of claim 7, wherein the pop-up elements comprise paper structures that partially unfold along a series of fold lines when the central tower moves in the vertical direction out of the top opening of the box.

9. A gift box configured to house pop-up elements, the gift box comprising:

a box-like body portion defined by a base and four side walls and having an open top;

a box-like lid defined by four sidewalls and a top and having an open bottom for receipt of an upper portion of the body portion to close its open top;

four levers that each pivot on a corresponding one of the four sidewalls of the body portion;

a band that is fastened to two of the four levers, wherein the two levers are positioned opposite to one another;

a central tower that is connected to the two levers, wherein the central tower automatically moves in a vertical direction out of the open top of the body portion when the band shortens, and wherein the band shortens when the lid is removed from the body portion; and a pop-up element connected to the central tower or one of the four levers, wherein the pop-up element partially unfolds along a series of fold lines when the central tower moves in a vertical direction out of the open top of the body portion of the gift box.

10. The gift box of claim 9, wherein, when the band shortens, a tension is released from the band and the two levers fastened to the band pivot in a first direction on the corresponding sidewalls.

11. The gift box of claim 10, wherein movement of the two levers fastened to the band in a second direction opposite the first direction increases a tension in the band.

12. The gift box of claim 9, wherein the central tower is configured to receive a gift card.

13. The gift box of claim 9, wherein the body portion, the lid, and the central tower are made from blanks of card stock.

14. The gift box of claim 9, wherein each of the four levers are connected to a portion of the central tower via an adhesive material.

15. A box that houses a plurality of structures, the box comprising:

a sidewall and a base, wherein the sidewall and the base cooperate to define an interior space of the box;

a flap that is connected to the sidewall, wherein the flap is foldable inwardly toward the interior space of the box;

a lever that is adhered to the flap, wherein the lever pivots on the sidewall;

a central structure that is connected to the lever, wherein the central structure moves in a vertical direction in and out of the interior space when the lever pivots on the sidewall; and a band that is fastened to the lever and wherein the band causes a portion of the lever to pivot outwardly toward an exterior portion of the sidewall when a tension in the band is partially released, thereby moving the central structure out of the interior space.

16. The box of claim 15, wherein the flap is a first flap and the lever is a first lever, wherein the box further includes a second flap connected with the sidewall opposite the first flap and a second lever adhered to the second flap, wherein the band passes through the interior portion of the box through holes in the sidewall, and wherein the band is coupled with the first and second levers to bias them in an outward direction.

17. The box of claim 15, wherein the central structure is partially disposed in the box when the lever is partially disposed in the box.

18. The box of claim 17, wherein when the central structure moves in the vertical direction toward a top opening of the box, the central structure and the lever fold outwardly from one another.

19. The structure of claim 18, wherein the central structure has a side that is parallel to the sidewall.

20. The structure of claim 15, wherein the lever and the central structure are die-cut from a single piece of material.

* * * * *